United States Patent [19]

Wilson

[11] Patent Number: 4,798,108

[45] Date of Patent: Jan. 17, 1989

[54] ADJUSTABLE SOCKET-FORMING DEVICE

[75] Inventor: Dennis W. Wilson, Sumner, Wash.

[73] Assignee: Designs Unlimited, Inc., Federal Way, Wash.

[21] Appl. No.: 605,467

[22] Filed: Apr. 30, 1984

[51] Int. Cl.[4] ..... B25B 13/16

[52] U.S. Cl. ..... 81/170

[58] Field of Search ..... 81/165, 167, 169, 170

[56] References Cited

U.S. PATENT DOCUMENTS

| | | | |
|---|---|---|---|
| 598,304 | 2/1898 | Cunningham | 81/170 X |
| 1,361,050 | 12/1920 | Hahn . | |
| 1,456,290 | 5/1923 | Tell | 81/165 |
| 2,801,562 | 8/1957 | Stricklett et al. | 81/163 |
| 3,707,100 | 12/1972 | Roberts | 81/175 |

FOREIGN PATENT DOCUMENTS

| | | | |
|---|---|---|---|
| 30284 | 11/1967 | Australia . | |
| 465209 | 3/1946 | Belgium . | |
| 447647 | 4/1948 | Canada . | |
| 524860 | 5/1956 | Canada . | |
| 475919 | 8/1914 | France . | |
| 62704 | 1/1924 | Sweden | 81/170 |
| 160008 | 3/1921 | United Kingdom . | |
| 1295523 | 11/1972 | United Kingdom . | |

*Primary Examiner*—James G. Smith

*Attorney, Agent, or Firm*—Christensen, O'Connor, Johnson & Kindness

[57] ABSTRACT

An adjustable socket-forming device (10) is disclosed that is adapted for use with a ratchet (26) or other tool to form an adjustable socket wrench. The socket-forming device includes a body (12), a movable gripping member (60) slidably mounted by the body, and a screw (80) for securing the movable gripping member at a selected position with respect to the body. The body includes a fixed gripping member (30) shaped so as to define a first group of faces (34, 36) of a polygonal socket, and the movable gripping member is shaped so as to define a second group of faces (66, 68) of the polygonal socket. The movable gripping member is slidably mounted by the body such that the first and second groups of faces are opposed, and such that the movable gripping member is movable with respect to the body to vary the distance between the groups of faces. Securing the movable gripping member at a selected position with respect to the body thereby defines a socket of a selected size.

5 Claims, 1 Drawing Sheet

ADJUSTABLE SOCKET-FORMING DEVICE

FIELD OF THE INVENTION

This invention relates to adjustable socket-forming devices and, in particular, to an adjustable socket-forming device adapted for use with a ratchet or other means to form an adjustable socket wrench.

BACKGROUND OF THE INVENTION

A number of adjustable socket-forming devices are described in the prior art. Such prior devices typically include two or more movable jaws and mechanisms for supporting the jaws and for varying the distance between the jaws while maintaining a rigid structure. The requirement that the devices be both adjustable and rigid has resulted in prior socket-forming devices of great complexity, such complexity being manifested by the large number of individual parts used to realize the devices, and by the intricate shapes of many of the parts. Because of such complexity, prior devices have been comparatively expensive to manufacture, and have proved vulnerable to failure, jamming and other defects.

SUMMARY OF THE INVENTION

The present invention provides an adjustable socket-forming device that is simple in construction yet extremely effective and easy to use. The device of the present invention is essentially realized using only three moving parts, thereby achieving the simplicity and reliability lacking in prior devices.

The socket-forming device of the present invention comprises a body, a movable gripping member slidably mounted by the body, and means for securing the movable gripping member at a selected position with respect to the body. The body includes a base adapted for connection to a source of rotary motion, and a fixed gripping member shaped so as to define a first group of faces of a polygonal socket. The movable gripping member is shaped so as to define a second group of faces of the polygonal socket. The movable gripping member is slidably mounted by the body such that the first and second groups of faces are opposed, and such that the movable gripping member is movable with respect to the body to vary the distance between the groups of faces. Securing the movable gripping member at a selected position with respect to the body thereby defines a socket of a selected size.

In a further aspect of the invention, the means for securing the movable gripping member comprises a screw connected between the body and the movable gripping member. The movable gripping member includes an internally threaded opening, and the screw includes a shaft that is journaled in the body and that includes a threaded portion that is received within such threaded opening. Rotation of the screw therefore causes the movable gripping member to move with respect to the body so as to vary the distance between the groups of faces.

In a further aspect of the invention, the first and second groups of faces respectively comprise first and second pairs of faces of a hexagonal socket. The fixed gripping member may have the approximate form of a hollow cylinder having a portion of one side removed, the interior surface of the hollow cylinder being shaped so as to define the first pair of faces and a pair of side faces disposed on opposite sides of the first pair of faces.

The movable gripping member is slidably mounted between the side faces for movement towards and away from the first pair of faces.

These and other features of the invention will become apparent in the detailed description and claims to follow, taken in conjunction with the accompanying drawings.

DETAILED DESCRIPTION OF THE INVENTION

Figure 1:
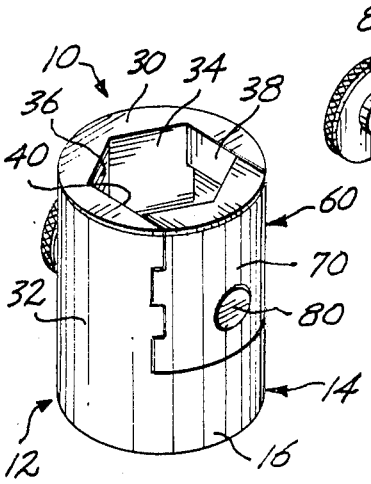
FIG. 1 is a perspective view of an adjustable socket-forming device according to the present invention.
Figure 2:
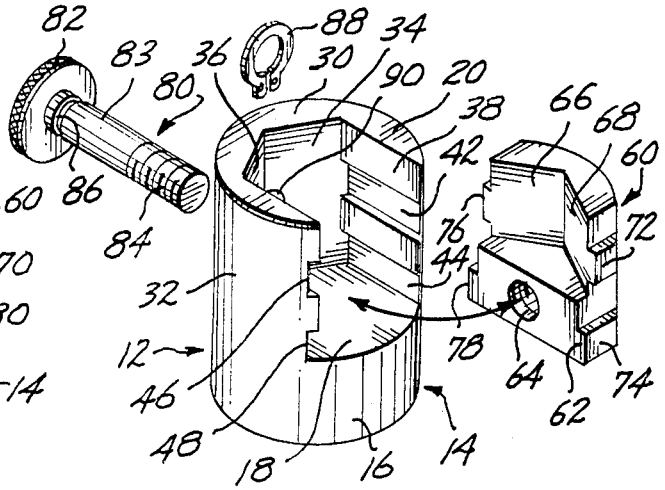
FIG. 2 is an exploded view of the device of FIG. 1.
Figure 5:
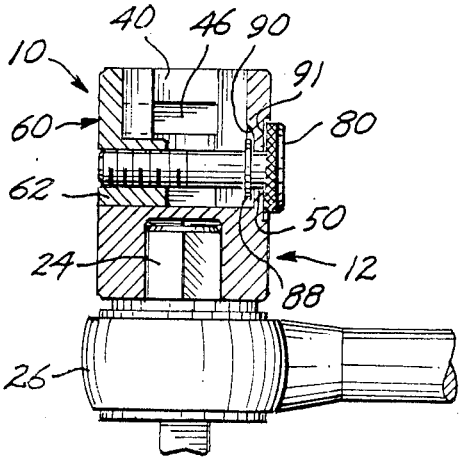
FIG. 5 is a partial cross-sectional view of the device of FIG. 1 connected to a ratchet.
Figure 6:
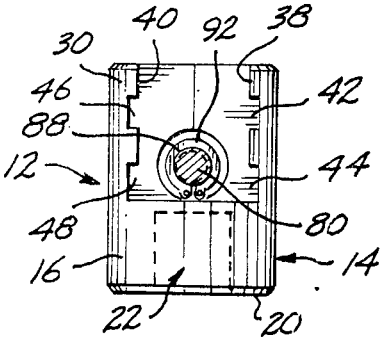
FIG. 6 is a side elevational view of the body of the device of FIG. 1 with the movable gripping member removed.

Referring initially to FIGS. 1 and 2, a preferred embodiment of socket-forming device 10 of the present invention is shown. The device comprises a generally cylindrical body 12 in which movable gripping member 60 is mounted. Body 12 comprises base 14 and first gripping member 30 extending upward from the base and integrally formed therewith. Base 14 is cylindrical in shape and includes cylindrical sidewall 16, upper surface 18, and lower surface 20 (FIG. 6). Lower surface 20 includes centrally located opening 22 that is adapted for connecting the socket-forming device to a source of rotary motion. In the embodiment illustrated, opening 22 has a square cross section and is adapted to receive lug 24 of ratchet 26 (FIG. 5), such that socket-forming device 10 of the present invention can be connected to ratchet 26 to form an adjustable socket wrench.

Fixed gripping member 30 generally comprises a hollow cylinder having a portion of one side removed, the fixed gripping member including cylindrical outer surface 32 and an inner surface that is formed into socket faces 34 and 36 and sidewalls 38 and 40. Each socket face 34 and 36 is planar, and the socket faces are inclined at a 60° angle with respect to one another so as to define two adjacent faces of a hexagonal socket. Sidewall 38 includes horizontal grooves 42 and 44 that extend for the full width of the sidewall. Sidewall 40 includes similar grooves 46 and 48. As described below, grooves 42, 44, 46 and 48 are used to slidably mount movable gripping member 60 in body 12. Sidewall 38 is inclined at an angle of 60° with respect to socket face 34, and sidewall 40 is inclined at an angle of 60° with respect to socket face 36. Sidewalls 38 and 40 are therefore parallel to one another, and socket faces 34 and 36 and sidewalls 38 and 40 define four adjacent sides of a hexagonal volume.

Movable gripping member 60 includes pedestal 62 having internally threaded opening 64 formed therein. Opening 64 extends completely through the movable gripping member. The upper, inner surface of movable gripping member 60 is shaped so as to form socket faces 66 and 68. Socket faces 66 and 68 are planar and are inclined at an angle of 60° with respect to one another so as to define two adjacent faces of a hexagonal socket. Outer surface 70 of movable gripping member 60 is cylindrical in shape and, as indicated in FIG. 1, the radius of curvature of outer surface 70 is identical to the radius of curvature of cylindrical outer surface 32 of fixed gripping member 30. Movable gripping member 60 includes lateral ridges 72 and 74 on one side thereof, and identical lateral ridges 76 and 78 on its opposite side. The movable gripping member is shaped and dimensioned such that it can be mounted in body 12, as indicated in FIGS. 1 and 2, with lateral ridges 72 and 74 slidably received within grooves 46 and 48 respectively, and lateral ridges 76 and 78 slidably received within grooves 42 and 44 respectively. When the movable gripping member is so mounted, the lower surface of the movable gripping member contacts upper surface 18 of base 14, and the movable gripping member is slidably supported by body 12 for motion towards and away from socket faces 34 and 36.

Screw 80 is provided for securing the movable gripping member at a selected position with respect to the body. Screw 80 comprises head 82 and shank 83 that includes threads 84 and groove 86. Threads 84 are sized so as to match the internal threads of opening 64, so that screw 80 can be threaded into such opening. Screw 80 is rotatably secured in opening 50 in body 12 by snap washer 88. The snap washer engages groove 86 of screw 80 and prevents axial movement of the screw in one direction with respect to the body. Axial movement of the screw in the opposite direction is prevented by head 82. Snap washer 88 is positioned in a recess 90 formed about opening 50 in socket faces 34 and 36, and head 82 is positioned in a similar but somewhat larger recess 91 formed in cylindrical outer surface 32.

Figure 4:
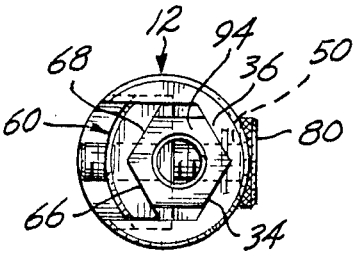
FIG. 4 is a plan view similar to FIG. 3, showing a smaller hexagonal nut gripped in the socket.

Socket-forming device 10 of the present invention is operative to define an adjustable socket between socket faces 34 and 36 of body 12 and socket faces 66 and 68 of movable gripping member 60. Screw 80 is mounted in body 12 such that the screw is free to rotate but is not free to move axially with respect to the body. Since screw 80 is threadably connected to movable gripping member 60, the result of rotating screw 80 is to vary the position of the movable gripping member with respect to body 12. In particular, rotation of screw 80 will cause movable gripping member 60 to move towards or away from socket faces 34 and 36, the direction of motion depending upon the direction of rotation of the screw. Screw 80 may therefore be used to adjust socket-forming device 10 to receive hexagonal nuts and other appropriately shaped objects of different sizes. To use the socket-forming device 10 of the present invention to rotate a nut, the socket-forming device is mounted to suitable means such as ratchet 26 (FIG. 5), and the device is positioned over a nut, such as nut 94 in FIG. 4, such that the nut is positioned between socket faces 34 and 36 of body 12 and socket faces 66 and 68 of movable gripping member 60. Screw 80 is then rotated in a direction to cause movable gripping member 60 to move towards socket faces 34 and 36, until nut 94 is firmly gripped between opposing pairs of socket faces. Rotation of ratchet 26 will then rotate hexagonal nut 94.

Figure 3:
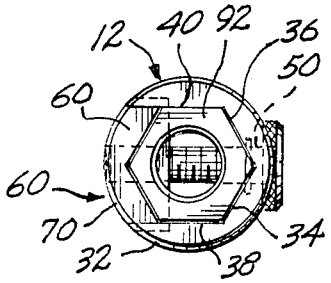
FIG. 3 is a plan view of the socket-forming device of FIG. 1 showing a hexagonal nut gripped in the socket.

FIG. 3 illustrates socket-forming device 10 used in connection with a larger hexagonal nut 92, nut 92 being the largest hexagonal object that can be accommodated by socket-forming device 10 in the embodiment illustrated. As indicated in FIG. 3, movable gripping member 60 has been moved away from socket faces 34 and 36, with respect to the configuration of FIG. 4, such that outer surface 70 of movable gripping member 60 is contiguous and concentric with outer surface 32 of fixed gripping member 30. In this configuration, socket faces 34, 36, 66 and 68 and sidewalls 38 and 40 form a regular hexagon, such hexagon defining the largest hexagonal object that socket-forming device 10 can accommodate. When the socket-forming device of the present invention is configured as shown in FIG. 3, sidewalls 38 and 40 function along with the socket faces to define the hexagonal socket for receiving nut 92.

For certain applications, the fixed and movable gripping members of the socket-forming device of the present invention may each be formed so as to define more than two socket faces. In such an embodiment, the movable gripping member and the body would be operative to form a polygonal socket, the size of the polygonal socket being adjustable in a manner similar to that of the hexagonal embodiment previously described.

While the preferred embodiments of the invention have been illustrated and described, it should be understood that variations will be apparent to those skilled in the art. Accordingly, the invention is not to be limited to the specific embodiments illustrated and described, and the true scope and spirit of the invention are to be determined by reference to the following claims.

The embodiments of the invention in which an exclusive property or privilege is claimed are defined as follows:

1. An adjustable socket-forming device, comprising:

a body comprising a base adapted for connection to a source of rotary motion and a fixed gripping member having the approximate form of a hollow cylinder having a portion of one side removed, the interior surface of the hollow cylinder being shaped so as to define a first pair of faces and a pair of mutually parallel side faces disposed on opposite sides of the first pair of faces;

a movable gripping member shaped so as to define a second pair of faces, the movable gripping member being slidably mounted between the side faces for movement along a first direction towards and away from the first pair of faces, the side faces and the movable gripping member including means for mounting the movable gripping member between the side faces for sliding movement along the first direction; and means for securing the movable gripping member at a selected position with respect to the body, to thereby form a socket of a selected size between the groups of faces.

2. The device of claim 1, wherein the side faces and the movable gripping member are shaped so as to form complementary ridges and grooves for slidably mounting the movable gripping member between the side faces.

3. The device of claim 2, wherein the interior surface of the hollow cylinder is shaped so as to form a planar surface extending between and normal to the first pair of faces and to the side faces, and wherein the movable gripping member includes a lower face adapted to slidingly abut said planar surface when the movable gripping member moves along the first direction.

4. The device of claim 3, wherein the outer surfaces of the fixed gripping member and the movable gripping member both comprise cylindrical segments, and wherein at one position of the movable gripping member along the first direction, said outer surfaces form a continuous cylindrical surface.

5. The device of claim 4, wherein said one position corresponds to the position at which the exposed area of each side face is approximately equal to the area of each face of said first and second pairs of faces.

* * * * *